United States Patent [19]

Becker

[11] 3,947,156

[45] Mar. 30, 1976

[54] DIAPHRAGM PUMP, PARTICULARLY FOR THE GENERATION OF VACUUM

[76] Inventor: Erich Becker, Lichtenbergstrasse 80, 78 Freiburg, Germany

[22] Filed: May 16, 1974

[21] Appl. No.: 470,469

Related U.S. Application Data

[63] Continuation-in-part of Ser. No. 334,940, Feb. 22, 1973, abandoned.

[30] Foreign Application Priority Data

Mar. 8, 1972 Germany ..... 2211096

[52] U.S. Cl. ..... 417/437; 92/99; 92/103 R; 417/413

[51] Int. Cl.[2] ..... F04B 45/04

[58] Field of Search ..... 417/395, 413; 92/98, 99, 92/101, 103

[56] References Cited

UNITED STATES PATENTS

| | | | |
|---|---|---|---|
| 1,711,803 | 5/1929 | Munday | 92/103 R |
| 1,999,675 | 4/1935 | White | 92/101 |
| 2,742,785 | 4/1956 | St. Clair | 92/103 X |
| 3,000,320 | 9/1961 | Ring | 417/395 X |
| 3,503,307 | 3/1970 | Migdal | 92/101 X |
| 3,722,506 | 3/1973 | McMillan, Jr. | 92/103 R |

FOREIGN PATENTS OR APPLICATIONS

| | | | |
|---|---|---|---|
| 659,791 | 7/1929 | France | 92/99 |
| 1,149,743 | 12/1957 | France | 92/99 |
| 975,545 | 3/1951 | France | |

*Primary Examiner*—C. J. Husar
*Assistant Examiner*—Leonard Smith
*Attorney, Agent, or Firm*—Michael J. Striker

[57] ABSTRACT

A diaphragm pump, especially a vacuum pump, in which a diaphragm of elastomeric material is clamped at its outer peripheral portion against a peripheral portion of a rigid wall which has, radially inwardly of the clamped portion, a concavely curved spherical surface forming with the diaphragm a pumping chamber with which inlet and outlet ports, each provided with a one-way valve, communicate. A central substantially rigid portion of the diaphragm is moved between a suction stroke increasing the volume of the pumping chamber, and a compression stroke. The wall surface and the diaphragm are constructed and arranged relative to each other that the volume of the pumping chamber is reduced substantially to zero at the end of the compression stroke and so as to permit easy sliding movement of portions of the diaphragm and the surface of the wall as the diaphragm approaches the end of the compression stroke.

13 Claims, 6 Drawing Figures

DIAPHRAGM PUMP, PARTICULARLY FOR THE GENERATION OF VACUUM

This is a continuation-in-part of Ser. No. 334,940, filed Feb. 22, 1973, and now abandoned.

BACKGROUND OF THE INVENTION

This invention relates to a diaphragm pump, particularly for the generation of vacuum, in which the central portion of the diaphragm is attached to a connecting rod of a crank drive, whereas its periphery is fixed in the pump chamber or some other part of the crank case of the pump.

Diaphragm pumps of the aforementioned kind are known in the art. A difficulty which arises in such diaphragm pumps is that of reducing or completely eliminating any clearance between the diaphragm and the surface of a wall facing the diaphragm and forming with the latter a pumping chamber at the top dead-center position of the crank drive. Any such remaining clearance will prevent the generation of a high vacuum and thereby reduce the performance of such a diaphragm pump.

Also known in the art are diaphragm pumps comprising a plurality of pumping elements working in series and disposed about a common drive shaft. However, the attainable vacuum cannot thus be substantially improved, despite a considerable increase in cost.

SUMMARY OF THE INVENTION

It is an object of the present invention to overcome the above mentioned disadvantages of diaphragm pumps known in the art.

It is an additional object of the invention to reduce the generation of noise during operation of such pumps.

Yet another object of the invention is to limit the stresses imparted to the diaphragm during operation.

With these and other objects in view, which will become apparent as the description proceeds, the diaphragm pump of the present invention, particularly a vacuum pump, mainly comprises a rigid wall having an inner surface with a central concavely curved spherical surface portion, a diaphragm facing the inner surface of the wall and having a peripheral portion fixed to the rigid wall radially outwardly of the central surface portion of the latter, a central substantially rigid portion having a convexly curved spherical surface facing and substantially matching the central concavely curved surface portion of the wall, and an annular flexible portion between the fixed spherical portion and the central portion thereof, inlet and outlet ports in the wall radially inwardly of the fixed diaphragm portion, and a one-way valve in each of said ports, and drive means rotatable about a fixed axis and a connecting rod connected at one end to the drive means pivotably about a pivot axis spaced from said fixed axis, and at the other end to the central portion of the diaphragm for moving the diaphragm between a suction stroke in which the central and flexible portions thereof are spaced from the inner surface of the wall to define with the latter a pumping chamber in which fluid is sucked through the inlet port, and a compression stroke during which fluid is displaced from the pumping chamber through the outlet port. The convexly curved spherical surface portion of the diaphragm has a radius of curvature which is substantially equal to the distance of any point of this surface from the aforementioned pivot axis, and the rigid wall has an annular surface portion facing the annular flexible portion of the diaphragm, and this annular surface portion of the wall deviates inwardly toward the flexible diaphragm portion from a hypothetical spherical surface of a radius of curvature equal to that of the substantially rigid central portion of the diaphragm.

This specific construction will assure that at the end of the compression stroke of the diaphragm the latter will be in contact substantially over its whole surface with the facing inner surface of the wall even though the flexible annular portion of the diaphragm tends, near the end of the compression stroke, to bulge away from the facing surface of the wall in the region of the outlet port for reasons which will be explained later on.

In one modification of the present invention, the central concavely curved spherical surface portion of the wall has exactly the same radius of curvature as the convexly curved central substantially rigid portion of the diaphragm and in this modification the annular surface portion of the wall is convexly curved toward the annular flexible portion of the diaphragm.

In another modification of the present invention, the annular surface portion of the wall is likewise concavely curved and has a common radius of curvature with the central concavely curved spherical portion of the wall and this common radius of curvature is slightly smaller than that of the central substantially rigid portion of the diaphragm. Preferably, the ratio of the common radius of curvature to that of the central portion of the diaphragm is 1:1.1.

According to a further feature of the present invention, the central and the annular surface portions of the wall are provided with a coating having a low friction and adhesion coefficient, whereby the stresses on the diaphragm during operation of the pump are reduced. Preferably, the Shore hardness of the central portion of the diaphragm exceeds 80 and that of the annular flexible portion of the diaphragm is between 40 and 80.

The central portion of the diaphragm is connected to the other end of the connectng rod in such a manner that this connection can be easily established and released, when necessary for repair purposes, and also in such a manner that the distance of the convexly curved central portion of the diaphragm from the fixed axis of the drive means may be held within close tolerances.

The drive means including the connecting rod are enclosed in a housing or crankcase and the aforementioned rigid wall which forms with the diaphragm the pumping chamber is connected to the crankcase in such a manner so as to be properly centralized with respect to the latter to thereby also establish the desired proper relationship of the concavely curved central surface portion of the wall and the fixed axis of the drive means within close tolerances.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
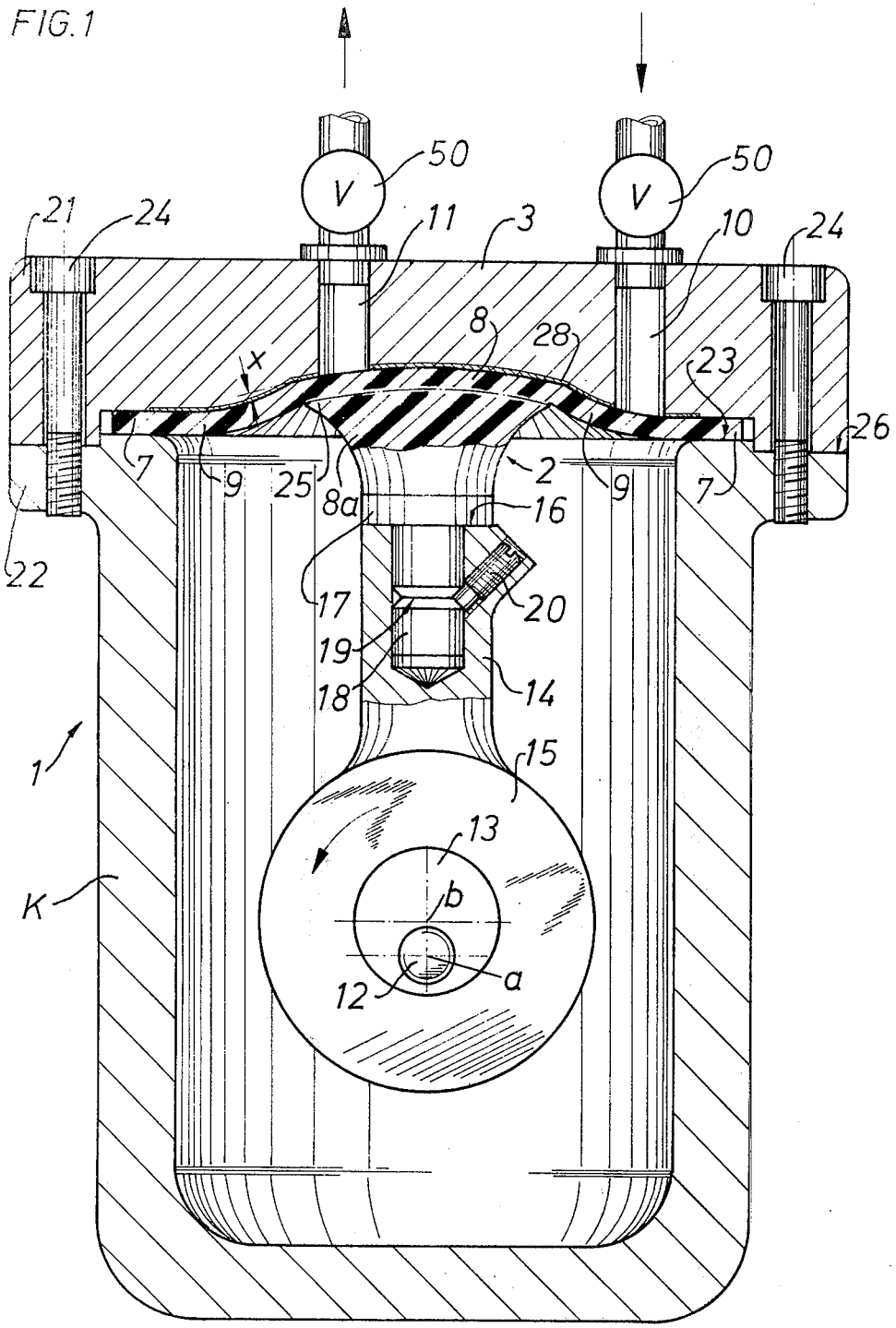
FIG. 1 is a longitudinal cross section through one embodiment of the diaphragm pump of the invention and showing the diaphragm at the end of the compression stroke.
Figure 2:
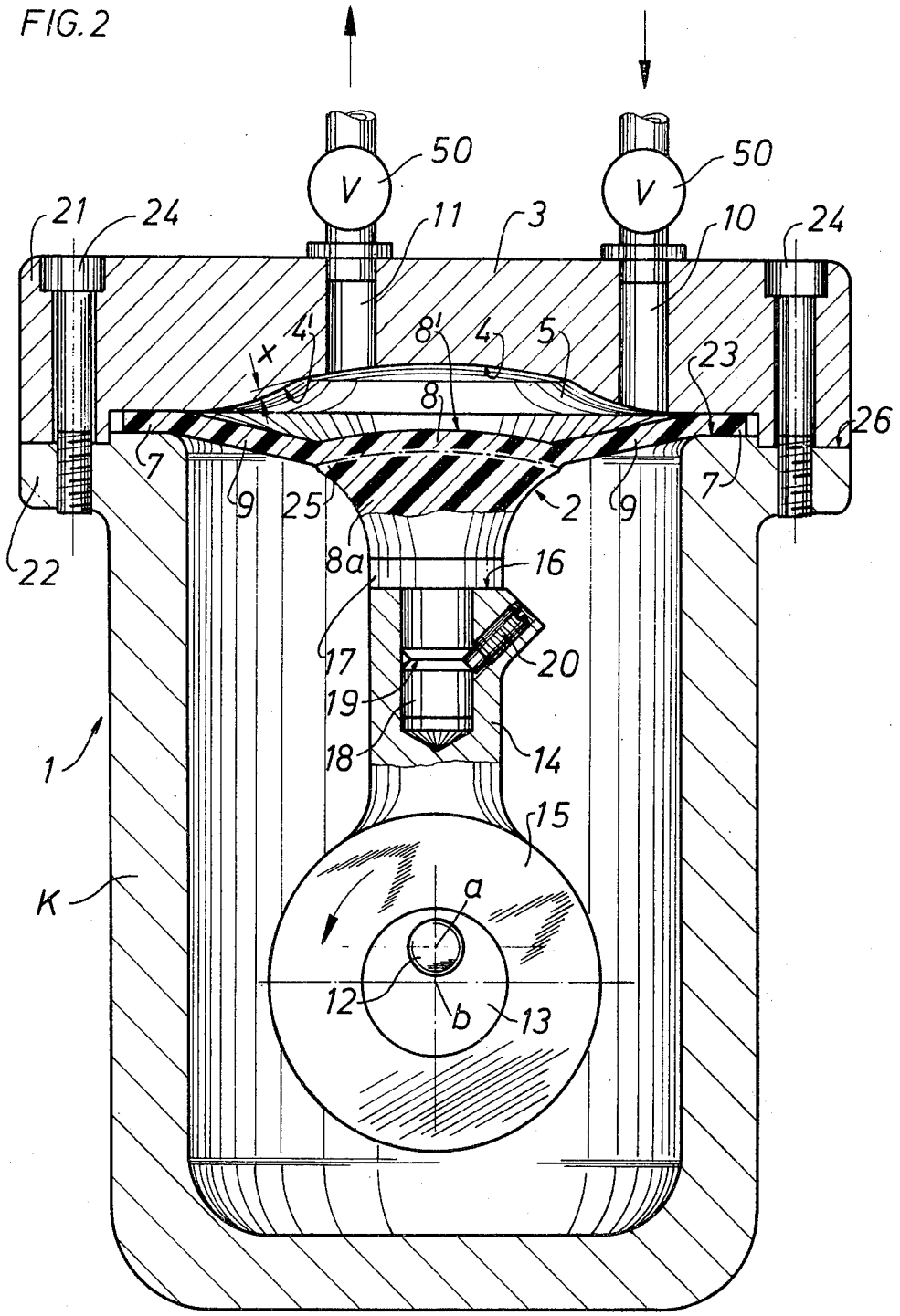
FIG. 2 is a cross section corresponding to that of FIG. 1 and showing the diaphragm at the end of the suction stroke.
Figure 3:
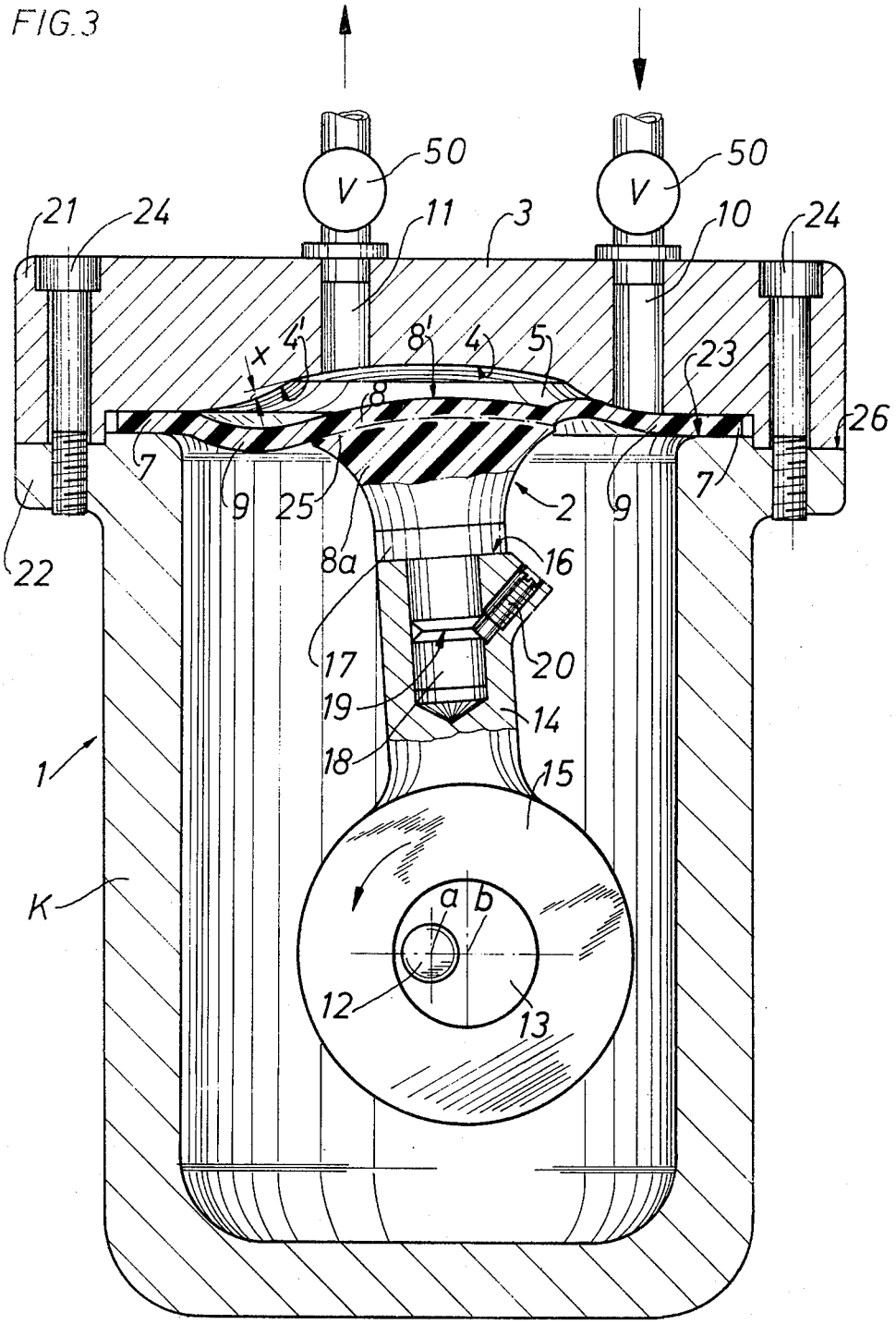
FIG. 3 is a cross section similar to that shown in FIG. 1 and showing the diaphragm as it approaches the end of the compression stroke.

Referring first to the embodiment illustrated in FIGS. 1–3 of the drawing, it will be seen that the diaphragm pump 1 illustrated in these three Figures comprises a crankcase or housing K having an upper open end, a rigid wall 3 above the upper open end of the crankcase K and a diaphragm 2 having a peripheral portion 7 clamped between a peripheral surface portion of the wall 3 and the upper surface 23 about the open end of the crankcase. The diaphragm 2 further comprises a central substantially rigid or unflexible portion 8 having an upper convexly curved spherical surface portion 8′ and between the clamped peripheral outer portion 7 and the central portion 8 an annular flexible portion 9. The diaphragm is provided in its central portion 8 with a stiffening member 25 so that the central portion, as mentioned before, is substantially inflexible. The central portion portion 8 of the diaphragm is further provided with a projection 8a projecting opposite from the surface 8′ therefrom and tapering towards its free end. A disc-shaped metal member 17 is connected, preferably by vulcanizing, to the free end of the projection 8*a* and the disc-shaped member in turn has a central cylindrical projection or stem 18 of smaller diameter than the disc-shaped member and integral therewith which is snugly received in a bore formed in the upper end of a connecting rod 14. The lower annular end 15 of the connecting rod encompasses a cylindrical member 13 eccentrically fixed to the drive shaft 12 mounted for rotation about a fixed axis a on bearings (not shown in the drawing) provided in the crankcase so that the lower end 15 of the connecting rod 14 will pivot, during rotation of the drive shaft 12 about its fixed axis *a*, about a pivot axis *b* spaced from the fixed axis.

The central projection 18 on the disc member 17 is held in the bore at the upper end of the connecting rod 14 by a set screw 20 engaging with its lower end a V-shaped groove 19 in the projection 18. Thereby, the disc-shaped member 17 is pressed with its lower face against the upper face 16 of the connecting rod so that the member 17 and the central portion 8 of the membrane can be held at close tolerances with respect to the axis b about which the connecting rod will pivot during rotation of the shaft 12.

The crankcase K has an annular flange 22 having an upper face slightly below the top face 23 about the open end of the crankcase, and the wall or cover 3 is provided with a corresponding flange portion 21 connected by screws 24 to the flange 22 so that the bottom face of the flange portion 21 will be pressed against the upper face 26 of the annular flange 22 whereby an inner cylindrical surface of the flange portion 21 will engage a corresponding outer surface of the crankcase K. This arrangement will assure that the cover 3 is properly centered with respect to the crankcase and therefore also with respect to the fixed axis a of the drive shaft 12. Additionally, this arrangement will greatly facilitate assembly and disassembly of the various elements of the pump, since, by removing the screws 24, the cover 3 may be lifted from the crankcase K, whereby the clamped outer annular portion 7 of the diaphragm 2 is released. By subsequently removing the set screw 20 the diaphragm 2 with the disc-shaped member 17 fixed thereto may be removed for replacement purposes without the necessity of disassembling the remaining parts of the pump.

The wall or cover 3 is provided with an inlet port 10 and an outlet port 11 each provided with a one-way valve 50 respectively opening in opposite directions.

According to the invention, the central convexly curved spherical surface 8′ of the substantially inflexible central portion 8 of the diaphragm has a radius of curvature which is equal to the distance of any point of this surface from the pivot axis *b*, and the central inner surface portion of the wall 3 which is a concavely curved spherical surface has in this modification the same radius of curvature. An outer annular portion of this inner surface of the cover 3 which faces the flexible portion 9 of the diaphragm deviates inwardly from this spherical surface towards the flexible portion of the diaphragm, and in the modification as shown in FIGS. 1–3, the annular surface portion 4′ is convexly curved toward the flexible portion 9 of the diaphragm, for a purpose which will be described later on. It is mentioned that the convexly curved annular surface portion 4′ is shown exaggerated in the drawing and the maximum dimension *x* at which this annular surface portion 4′ deviates from the spherical surface portion of the same radius of curvature as the central portion 8′ of the diaphragm is in the region of 1 mm or less. As can be seen from FIGS. 1–3, the inlet port 10 is spaced further from a central longitudinal plane of the pump than the outlet port 11.

Figure 5:
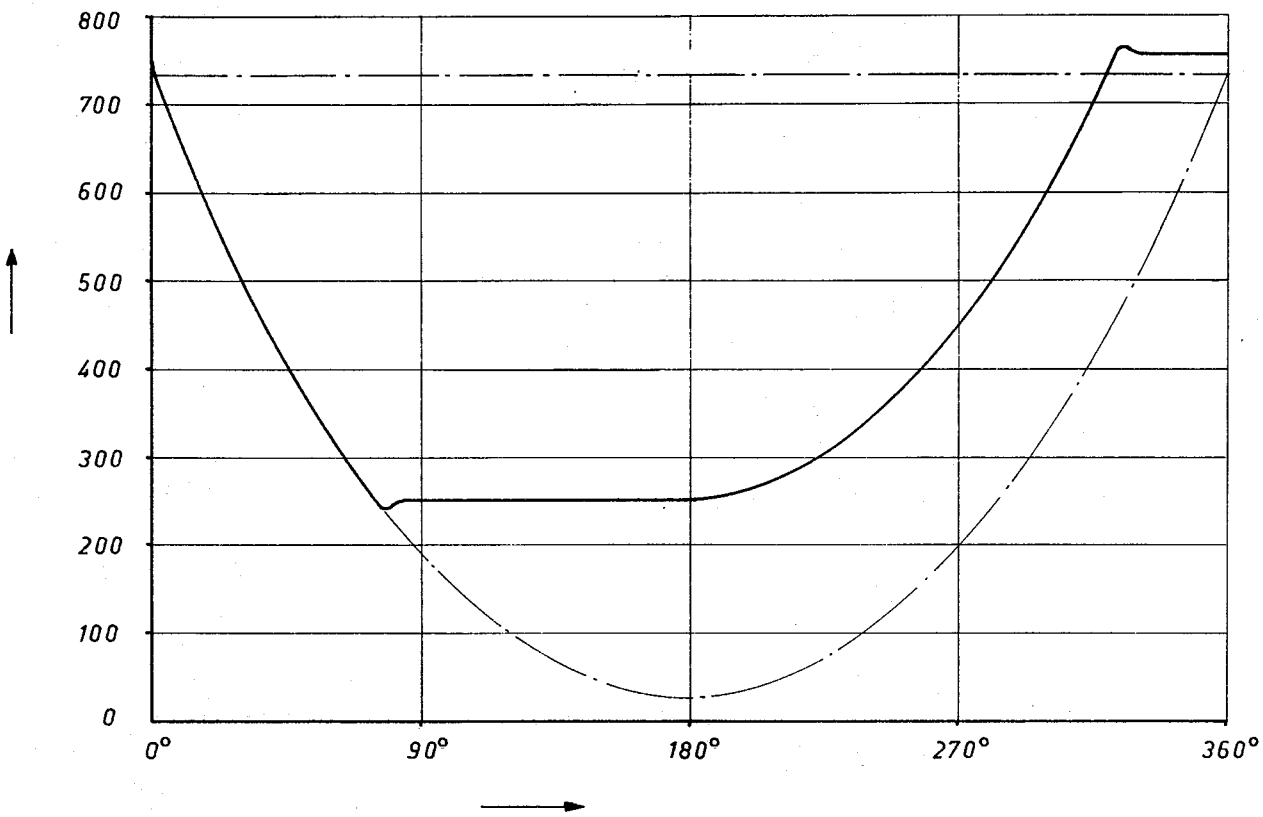
FIG. 5 is diagram illustrating the pressure in the pumping chamber in dependence on the turning angle of the crank drive.

The above described diaphragm pump, which is to be used as a vacuum pump, will operate as follows:

In FIG. 1, the crank drive of the pump is shown in its upper dead-center position, and in this position the upper surface of the diaphragm 2 engages over its whole area the inner surface of the cover 3. During rotation of the drive shaft 12, in the direction as indicated by the arrow, the crank drive will move to its lower dead-center position, as illustrated in FIG. 2, and during such movement a gaseous fluid will be sucked through the inlet port 10 and the valve 50 into the pumping chamber 5 formed between the upper surface of the diaphragm and the inner surface 4, 4′ of the cover 3. During such turning of the crank drive through an angle of 180°, the pressure in the pumping chamber 5 will decrease, as indicated in the diagram of FIG. 5. During further rotation of the crank drive, the gaseous fluid will be discharged from the pumping chamber through the outlet port 11 and the one-way valve 50 connected thereto, whereby the outside pressure and the resistance of the one-way valve against opening has to be overcome so that the pressure in the pumping chamber will rise, and actually surpass atmospheric pressure as indicated in FIG. 5. Since during such movement of the crank drive from its lower dead-center position back to its upper dead-center position, the connecting rod 14 will be slightly inclined with respect to the vertical as indicated in FIG. 3, the right portion of the flexible annular portion 9 of the diaphragm will first contact the inner surface of the cover 3 and close the inlet port, whereas the left portion of the flexible annular portion 9 of the diaphragm will, under the influence of the increasing pressure in the pumping chamber 5, bulge slightly downwardly away from the annular surface portion 4' of the cover 3. To avoid that this downwardly bulging portion of the diaphragm will, at the end of the compression stroke, remain spaced from the inner surface of the cover 3 this inner surface is provided, as mentioned before, with an annular outer portion 4' which deviates inwardly from a spherical surface having the same radius of curvature as the convexly curved spherical surface 8'. Providing such an inwardly deviating annular surface portion on the cover 3, shown in the embodiment of FIGS. 1–3 as a convexly curved annular surface portion 4', will assure that at the end of the compression stroke no dead space will be created between the upper surface of the diaphragm in the region of the left flexible portion thereof and the inner surface of the cover 3 and this omission of any dead space will evidently improve the vacuum obtainable with the pump according to the invention.

During operation of the pump, the upper surface 8' will at the end of the compression stroke make a slight sliding movement relative to the inner surface 4 of the cover 3 and by making the central portion of the surface 4 with the same radius of curvature than the surface 8' such sliding movement will be facilitated and the stresses imparted to the membrane during such sliding movement at the same time reduced. To further reduce the friction between the upper surface of the membrane and the inner surface of the cover, this inner surface 4, 4', is preferably covered with a coating 28 having a low friction and adhesion coefficient, and such coating may for instance be made of Teflon. The diaphragm itself is made of elastomeric material, for instance natural or synthetic rubber, and the thickness of the annular portions 7 and 9 of the diaphragm is about 0.5 to 4 mm. The central portion 8 of the diaphragm is preferably harder than the annular flexible portion 9 thereof and the Shore hardness of the central portion is preferably above 80, whereas the Shore hardness of the annular flexible portion is between 40 and 80.

Figure 4:
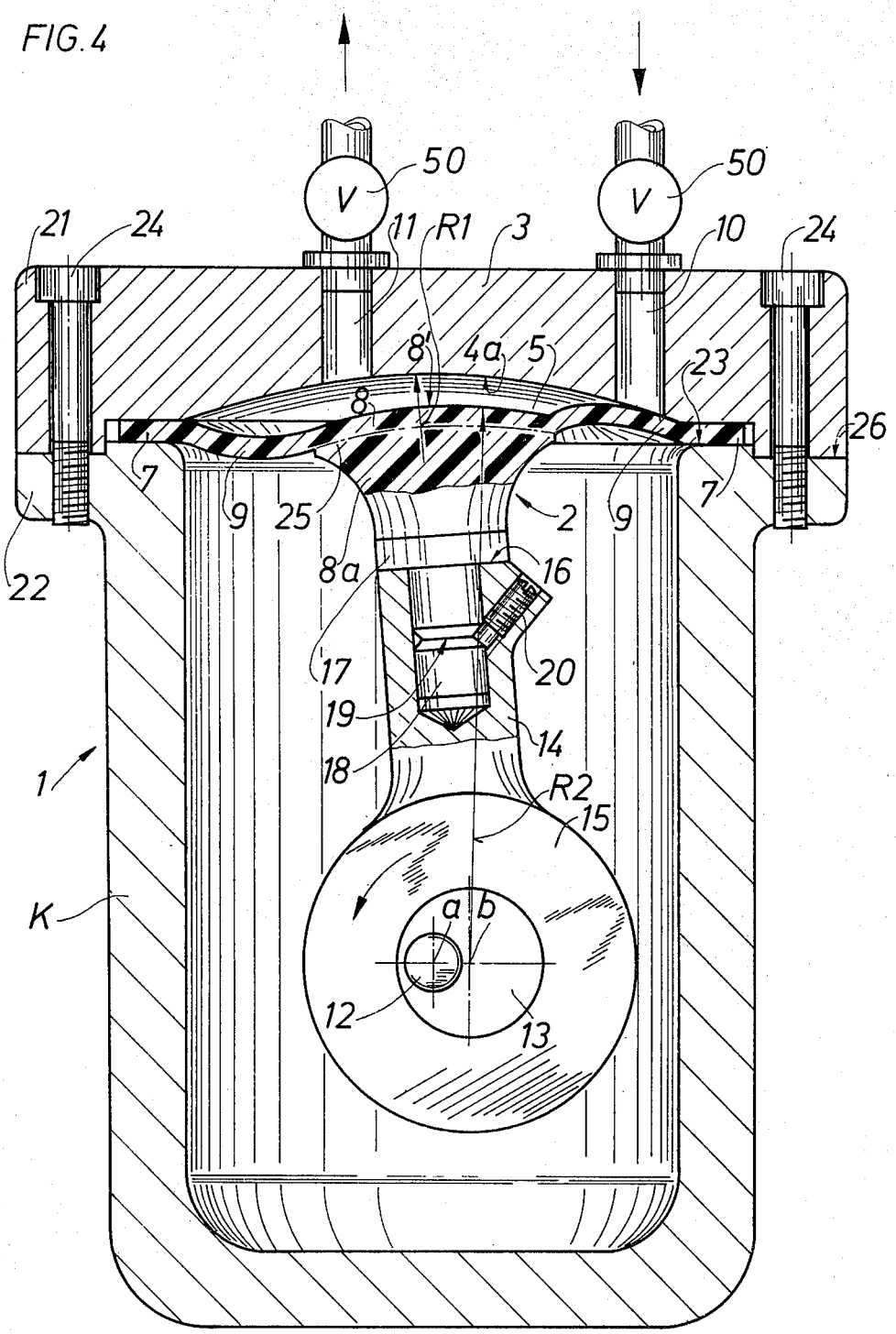
FIG. 4 is a cross section similar to that shown in FIG. 2 and illustrating another embodiment according to the present invention.

The embodiment illustrated in FIG. 4 differs from the above described embodiment illustrated in FIGS. 1–3 only in that the inner surface 4a of the cover 3 is configurated slightly different than in the above described embodiment.

Figure 4A:
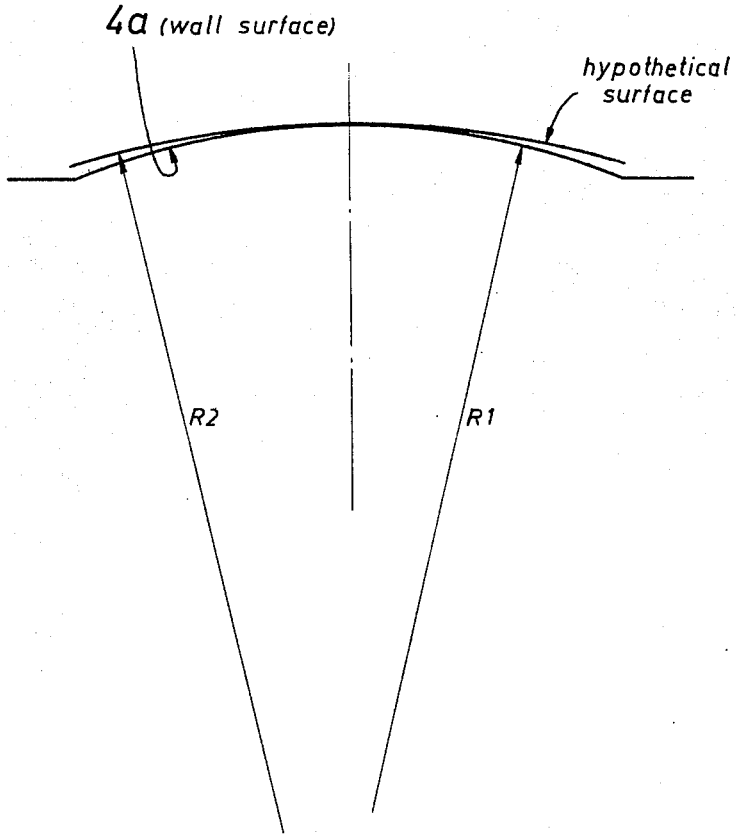
FIG. 4*a* is a schematic explanatory Figure referring to the embodiment shown in FIG. 4.

More specifically, in the embodiment shown in FIG. 4, the radius of curvature R1 of the inner concavely curved spherical surface **4*a* of the cover 3 is slightly smaller than the radius of curvature R2 of the convexly curved surface 8' of the central portion 8 of the diaphragm. Therefore, in this construction too the outer annular portion of the inner surface 4a will deviate inwardly toward the flexible annular portion 9 of the diaphragm from a hypothetical surface with the same radius of curvature as the central spherical surface portion 8' of the diaphragm, as schematically shown in FIG. 4*a*. Therefore, in this construction a dead space between the upper surface of the diaphragm and the inner surface 4*a* of the cover 3, at the end of the compression stroke, is likewise avoided and the same advantageous results can be obtained with the specific construction as shown in FIG. 4 as is obtainable with the construction of the embodiment illustrated in FIGS. 1–3. Evidently, by making the inner surface 4*a* of the cover with a uniform radius of curvature, the machining of the cover in the embodiment shown in FIG. 4 is simpler than the machining of the cover in the embodiment illustrated in FIGS. 1–3. The difference between the radii R1 and R2 is shown exaggerated in FIG. 4*a* and the relationship of R1 to R2 is preferably 1:1.1. As evident from FIG. 4*a*, the central surface portion 8' of the diaphragm will at the end of the compression stroke tightly abut against the central portion of the inner surface portion 4*a* of the cover, even if the flexible portion should bulge slightly inwardly due to the conditions described above, the flexible portion of the diaphragm will still be in tight engagement with the inner surface 4*a***, due to the specific construction of this surface.

It will be understood that each of the elements described above, or two or more together, may also find a useful application in other types of diaphragm pumps differing from the types described above.

While the invention has been illustrated and described as embodied in a diaphragm pump operated as a vacuum pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A diaphram pump, particularly a vacuum pump, comprising a rigid wall having an inner surface with a central concavely curved spherical surface portion; a diaphragm facing said inner surface of said wall and having an outer peripheral portion fixed to said rigid wall radially outwardly of said central surface portion of the latter, a central substantially rigid portion having a convexly curved spherical surface facing and substantially matching said central concavely curved surface portion of said wall, and an annular flexible portion therebetween, integral with and of the same material as said fixed peripheral portion and said central portion thereof; inlet and outlet ports in said wall radially inwardly of said fixed diaphragm portion and a one-way valve in each of said ports; and drive means rotatable about a fixed axis and a connecting rod connected at one end to said drive means pivotable about a pivot axis spaced from said fixed axis and at the other end to said central portion of the diaphragm for moving said diaphragm between a suction stroke in which said central and flexible portions thereof are spaced from said inner surface of said wall to define with the latter a pumping chamber into which fluid is sucked through said inlet port, and a compression stroke during which fluid is displaced from said pumping chamber through said outlet port, said convexly curved spherical surface of said diaphragm having a radius of curvature which is substantially equal to the distance of any point of said surface from said pivot axis, and said rigid wall having an annular surface portion facing said annular flexible portion of said diaphragm and deviating inwardly toward said flexible diaphragm portion from a hypothetical spherical surface of a radius of curvature equal to that of said central substantially rigid portion of said diaphragm.

2. A diaphragm pump as defined in claim 1, wherein said central concavely curved spherical surface portion of said wall has the same radius of curvature as said convexly curved central rigid portion of said diaphragm and wherein said annular surface portion of said wall is convexly curved toward said annular flexible portion of said diaphragm.

3. A diaphragm pump as defined in claim 1, and including a coating having a low friction and adhesion coefficient covering said central and said annular surface portion of said wall.

4. A diaphragm pump as defined in claim 1, and including a housing surrounding and rotatably mounting said drive means, said housing having an open end and at said open end an annular end face facing said rigid wall, said peripheral portion of said diaphragm being located between said annular end face of said housing and said rigid wall, and including connecting means radially outwardly of said peripheral portion of said diaphragm for pressing said wall against said end face so as to clamp said peripheral portion of said diaphragm therebetween, and means for centering said wall relative to said housing.

5. A diaphragm pump as defined in claim 4, wherein said housing has at said open end an outer cylindrical surface and a radially outwardly projecting flange axially spaced from said end face of said housing, said wall having an outer annular portion with an inner cylindrical surface engaging said outer cylindrical surface so as to center said wall on said housing, and said connecting means including screw means extending through aligned bores in said outer annular portion of said wall and said flange.

6. A diaphragm pump as defined in claim 1, wherein said inlet and said outlet ports are located in a plane normal to said fixed axis of said drive means and the latter are rotated in a direction that during the compression stroke a portion of the diaphragm in the region of said outlet port is the last to engage said inner surface of said wall.

7. A diaphragm pump as defined in claim 1, wherein said outlet port is offset to one side of a vertical plane of symmetry passing through said fixed axis for a distance which is smaller than the distance said inlet port is offset to the other side of said plane.

8. A diaphragm pump as defined in claim 1, wherein said diaphragm is formed from elastomeric material and wherein the Shore hardness of said central portion of said diaphragm exceeds 80 and that of said annular flexible portion is between 40 and 80.

9. A diaphragm pump as defined in claim 1, wherein said annular surface portion of said wall is likewise concavely curved and has a common radius of curvature with said central concavely curved spherical portion of said wall, said common radius of curvature being smaller than that of said convexly curved spherical surface of said central substantially rigid portion of said diaphragm.

10. A diaphragm pump as defined in claim 9, wherein the ratio of said common radius of curvature to that of said convexly curved spherical surface of said central portion of said diaphragm is 1:1.1.

11. A diaphragm pump as defined in claim 1, wherein said central portion of said diaphragm has an integral projection projecting opposite from said convexly curved surface thereof for attaching said connecting rod thereto.

12. A diaphragm pump as defined in claim 11, said connecting rod having at said other end an end face spaced from said projection and being provided with a central bore extending from said end face into said rod, and including a metal member fixed to said projection and having an end face abutting against said end face of said rod and a central stem integral with said metal member and projecting into said bore, and co-operating means on said stem and said connecting rod for holding said end faces in tight abutment against each other.

13. A diaphragm pump as defined in claim 11, wherein said integral projection tapers away from said convexly curved spherical surface of said central portion.

* * * * *